US011137221B2

(12) United States Patent
Spangler et al.

(10) Patent No.: US 11,137,221 B2
(45) Date of Patent: Oct. 5, 2021

(54) BOLT GAS PORTS

(71) Applicant: Daniel Defense, Inc., Black Creek, GA (US)

(72) Inventors: Julian James Spangler, Savannah, GA (US); Marvin C. Daniel, Pooler, GA (US)

(73) Assignee: Daniel Defense, LLC, Black Creek, GA (US)

( * ) Notice: Subject to any disclaimer, the term of this patent is extended or adjusted under 35 U.S.C. 154(b) by 0 days.

(21) Appl. No.: 16/670,485

(22) Filed: Oct. 31, 2019

(65) Prior Publication Data

US 2020/0158452 A1 May 21, 2020

Related U.S. Application Data

(60) Provisional application No. 62/770,600, filed on Nov. 21, 2018.

(51) Int. Cl.
*F41A 5/24* (2006.01)
*F41A 3/74* (2006.01)
*F41A 3/26* (2006.01)

(52) U.S. Cl.
CPC . *F41A 5/24* (2013.01); *F41A 3/26* (2013.01)

(58) Field of Classification Search
CPC ..... F41A 5/24; F41A 3/14; F41A 3/16; F41A 3/26; F41A 3/28; F41A 3/30; F41A 3/62; F41A 3/74; F16J 9/22
See application file for complete search history.

(56) References Cited

U.S. PATENT DOCUMENTS 3,463,057 A * 8/1969 Squinto ..... F16J 9/24 92/233
3,554,564 A * 1/1971 Lassanske ..... F16J 9/00 277/452
3,608,911 A * 9/1971 Prasse ..... F16J 9/28 277/468
3,626,812 A * 12/1971 Trick ..... F15B 15/224 92/85 R
3,806,137 A * 4/1974 Prasse ..... F16J 9/206 277/468
5,083,536 A * 1/1992 Ariga ..... F16J 9/08 123/193.6
5,737,999 A * 4/1998 Ariga ..... F16J 1/08 123/193.6
7,275,472 B1 * 10/2007 Finn ..... F41A 3/74 89/26
7,886,470 B1 * 2/2011 Doiron ..... F41A 3/46 42/69.02

(Continued)

*Primary Examiner* — Derrick R Morgan
(74) *Attorney, Agent, or Firm* — Merchant & Gould P.C.

(57) ABSTRACT

A bolt may be provided for a bolt carrier. The bolt carrier may comprise a gas inlet, a gas expansion chamber, a bolt bore, and the bolt. The gas expansion chamber that may receive a pressurized gas from the gas inlet. The bolt may be disposed in the bolt bore in the bolt carrier. The bolt may comprise a gas ring groove, a gas ring assembly disposed in the gas ring groove, and at least one gas port. The gas ring assembly may be adjacent to the bolt bore. The at least one gas port may provide a pathway for the pressurized gas from the gas expansion chamber to a volume underneath the gas ring assembly to increase a radial sealing force between the gas ring assembly and the bolt bore.

6 Claims, 5 Drawing Sheets

(56) References Cited

U.S. PATENT DOCUMENTS

| | | | | |
|---|---|---|---|---|
| 8,177,237 | B2 * | 5/2012 | Lindner-Silwester | F16J 9/18 277/487 |
| 8,991,295 | B2 * | 3/2015 | Larue | F41A 5/24 89/193 |
| 9,334,830 | B2 * | 5/2016 | Donahue | F16J 9/08 |
| 9,470,179 | B2 * | 10/2016 | Donahue | F16J 9/08 |
| 9,488,423 | B2 * | 11/2016 | Sullivan | F41G 1/02 |
| 9,845,765 | B2 * | 12/2017 | Donahue | F02F 3/24 |
| 9,857,129 | B1 * | 1/2018 | Kelly | F41A 3/30 |
| 10,094,475 | B2 * | 10/2018 | Didwiszus | F16J 15/164 |
| 10,386,142 | B2 * | 8/2019 | Brown | F41A 35/06 |
| 10,422,596 | B2 * | 9/2019 | Kramer | F41A 5/22 |
| 10,851,893 | B2 * | 12/2020 | Coleman | F16J 9/12 |
| 2008/0229922 | A1 * | 9/2008 | Lahrman | F16J 9/22 92/172 |
| 2012/0080854 | A1 * | 4/2012 | Slack | F16J 15/48 277/500 |
| 2013/0200573 | A1 * | 8/2013 | Garrison | F16J 15/3412 277/457 |
| 2014/0260958 | A1 * | 9/2014 | Labrie | F04B 53/143 92/172 |
| 2016/0369894 | A1 * | 12/2016 | Schroder | F16J 1/09 |
| 2018/0172373 | A1 * | 6/2018 | Maranli | F41A 3/26 |
| 2020/0132193 | A1 * | 4/2020 | Scharp | F16J 1/08 |
| 2020/0158452 | A1 * | 5/2020 | Spangler | F41A 3/26 |

* cited by examiner

BOLT GAS PORTS

RELATED APPLICATION

Under provisions of 35 U.S.C. § 119(e), Applicant claims the benefit of U.S. Provisional Application No. 62/770,600 filed Nov. 21, 2018, which is incorporated herein by reference.

BACKGROUND

A semi-automatic rifle may comprise a self-loading firearm whose action automatically cycles (i.e., ejects and rechambers) a new cartridge after each shot, but needs the operator to manually reset a hammer. The hammer needs to reset by relaxing the trigger before the next shot may be fired. Accordingly, only a single round may be discharged each time the trigger is depressed. In contrast, a fully-automatic (i.e., full-auto) rifle both cycles cartridges automatically and cycles (i.e., resets and releases) the hammer automatically as opposed to semi-auto firearms, which do only the former when the trigger is pulled. Consequently, for the duration of the trigger-pull, the full-auto rifle will fire multiple cartridges continuously until the full-auto rifle's magazine is depleted.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1A:
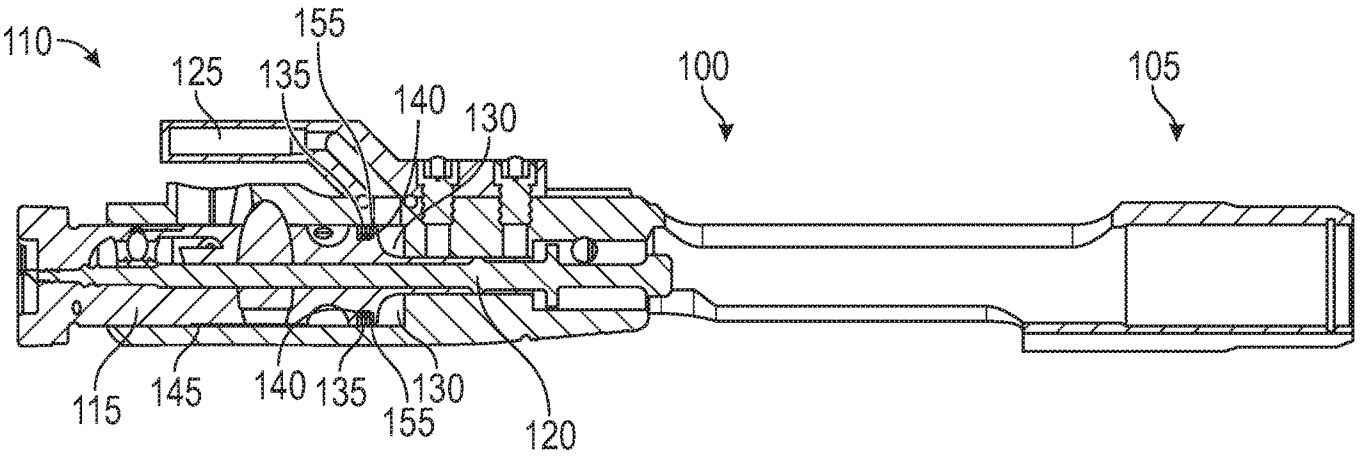
FIG. 1A shows a bolt carrier.

A bolt may be provided for a bolt carrier. The bolt carrier may comprise a gas inlet, a gas expansion chamber, a bolt bore, and the bolt. The gas expansion chamber that may receive a pressurized gas from the gas inlet. The bolt may be disposed in a bore in the bolt carrier. The bolt may comprise a gas ring groove, a gas ring assembly disposed in the gas ring groove, and at least one gas port. The gas ring assembly may be adjacent to the bolt bore. The at least one gas port may provide a pathway for the pressurized gas from the gas expansion chamber to a volume underneath the gas ring assembly to increase a radial sealing force between the gas ring assembly and the bolt bore.

Both the foregoing overview and the following example embodiments are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiments.

EXAMPLE EMBODIMENTS

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Embodiments of the disclosure may provide gas ports that may be used in conjunction with a bolt carrier of a semi-automatic, gas operated rifle for example. The gas ports may be lateral or vertical. Embodiments of the disclosure may include a bolt with gas ports that may allow propellant gas pressure to flow underneath a gas ring assembly to increase a radial sealing force by utilizing the propellant gas pressure. The radial sealing force may be produced due to gas ring assembly tension and an axial force on the gas ring assembly by the propellant gas pressure. Accordingly, consistent with embodiments of the disclosure, overall gas leakage may be reduced due to the increased seal thus increasing efficiency by allowing more force to be transferred axially. Due to this gas leakage reduction, the required gas may be reduced and or the initial tension of the gas ring assembly may be relaxed.

Lateral gas ports or vertical gas ports may be applied to gain the aforementioned advantage to provide a channel to the back side (i.e., underneath) of the gas ring assembly. Gas ports to allow gas to the backside of the gas ring assembly may take many shapes such as grooves or channels to allow the gas propellant flow. The gas ports may also comprise openings or cutouts of various shapes creating a path or a channel.

Consistent with embodiments of the disclosure, gas ports, both lateral and vertical, may be applied to any firearm operating system utilizing gas pressure that may come in contact with a gas ring (i.e., a gas ring assembly). Included are both a smaller rifle and a larger shotgun gas piston, both which employ gas rings for improved sealing to operate the firearm.

FIG. 1A shows a bolt carrier 100 consistent with embodiments of the disclosure. As shown in FIG. 1A, bolt carrier 100 may comprise a rear 105, a front 110, a bolt 115, a firing pin 120, a gas inlet 125, and a gas expansion chamber 130. Bolt 115 may comprise a gas ring assembly 135 and a gas ring groove 140. Bolt 115 may be disposed within a bolt bore 145 of bolt carrier 100. Consistent with embodiments of the disclosure, bolt 115 may include a gas port 155 described in greater detail below. During operation, pressurized propellant gas may enter gas inlet 125 and continue to gas expansion chamber 130. This may cause a firearm in which bolt carrier 100 is disposed to cycle (i.e., bolt carrier 100 extracts a spent casing and put a new round into the firearm's chamber).

Figure 1B:
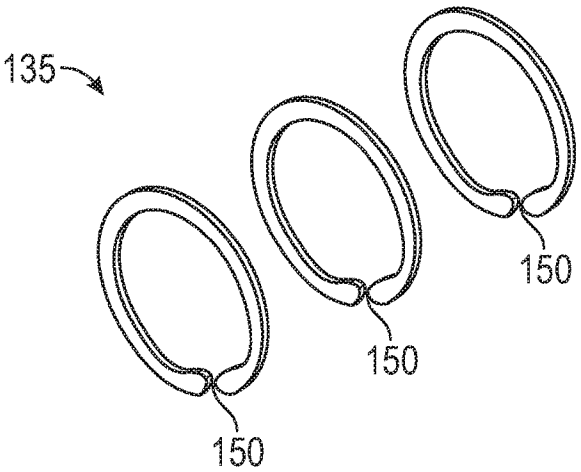
FIG. 1B shows a gas ring assembly.

FIG. 1B shows gas ring assembly 135 in more detail. As shown in FIG. 1B, gas ring assembly 135 may comprise one of more rings that may be disposed in gas ring groove 140. Consistent with embodiments of the disclosure, each of the one or more rings may include a gap 150. While FIG. 1B shows gas ring assembly 135 having three rings, embodiments of the disclosure are not so limited and may include any number of rings.

Figure 2A:
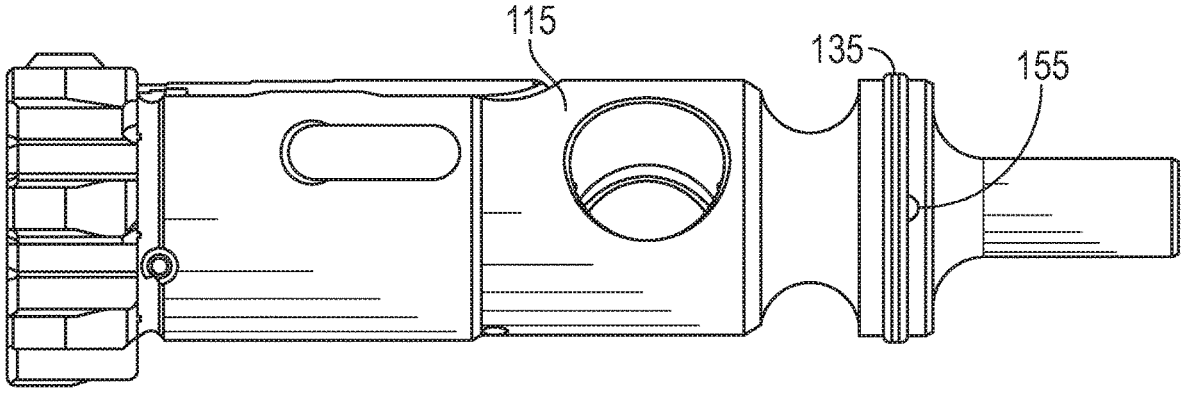
FIGS. 2A and 2B show a bolt having at least one vertical gas port with the gas ring assembly included.
Figure 2B:
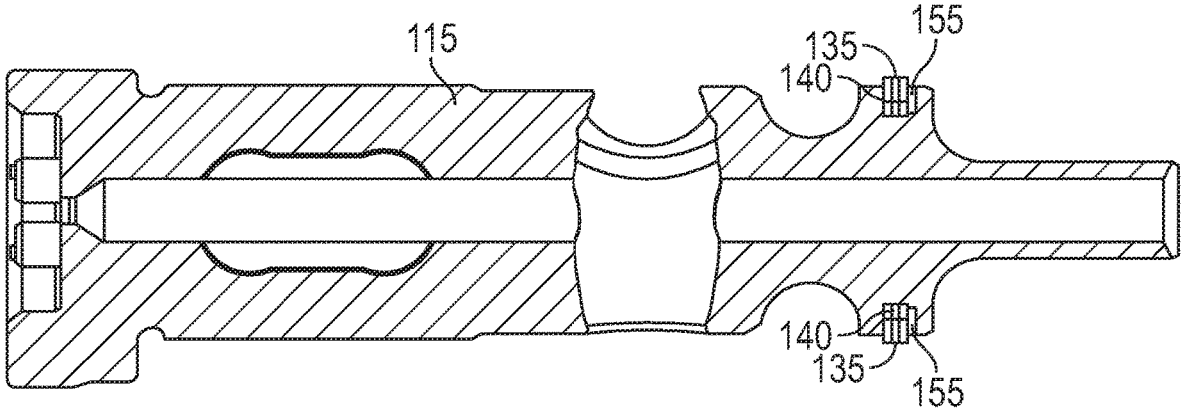
Figure 3A:
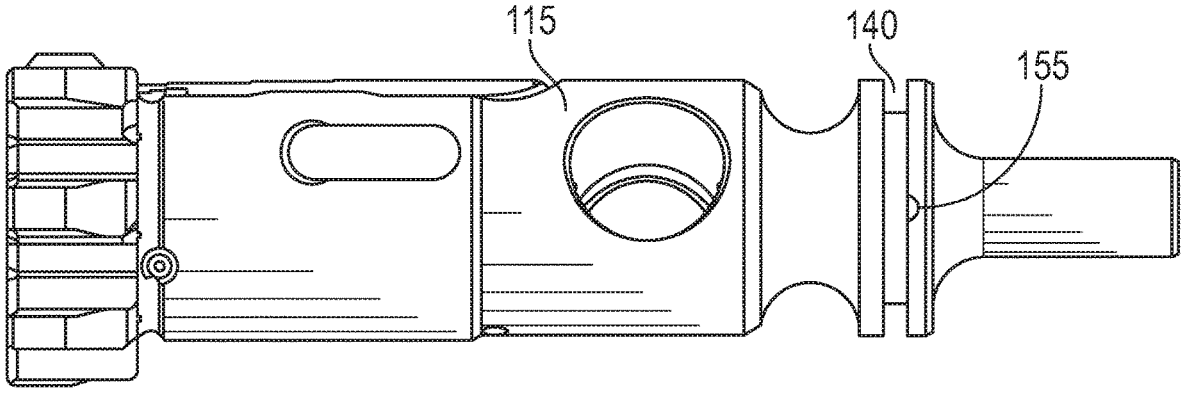
FIGS. 3A and 3B show a bolt having at least one vertical gas port with the gas ring assembly removed.
Figure 3B:
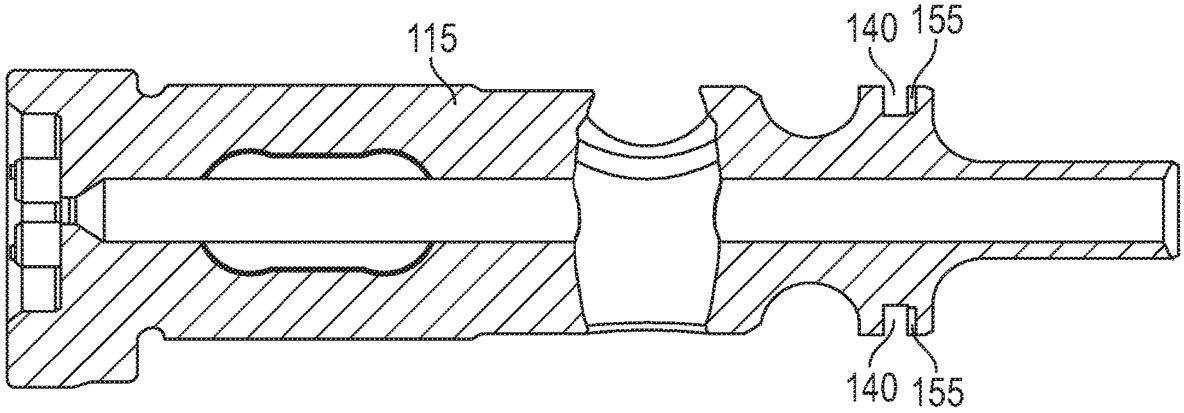

FIGS. 2A and 2B show bolt 115 having at least one vertical gas port 155 with gas ring assembly 135 included in gas ring groove 140. FIGS. 3A and 3B show bolt 115 having at least one vertical gas port 155 with gas ring assembly 135 removed. While FIGS. 2A, 2B, 3A, and 3B show one vertical gas port 155, embodiments of the disclosure may include any number of gas ports 155 and are not limited to one.

Consistent with embodiments of the disclosure, gas port 155 may allow gas pressure from gas expansion chamber 130 to flow underneath gas ring assembly 135 to increase a radial sealing force against bolt bore 145 by utilizing the propellant gas pressure. The radial sealing force against bolt bore 145 may be produced due to tension of gas ring assembly 135 and an axial force on gas ring assembly 135 by propellant gas pressure. Accordingly, consistent with embodiments of the disclosure, overall gas leakage may be reduced due to the increased seal against bolt bore 145 thus increasing efficiency by allowing more force to be transferred axially. Due to this gas leakage reduction, the required gas may be reduced and or the initial tension of gas ring assembly 135 may be relaxed.

Figure 4B:
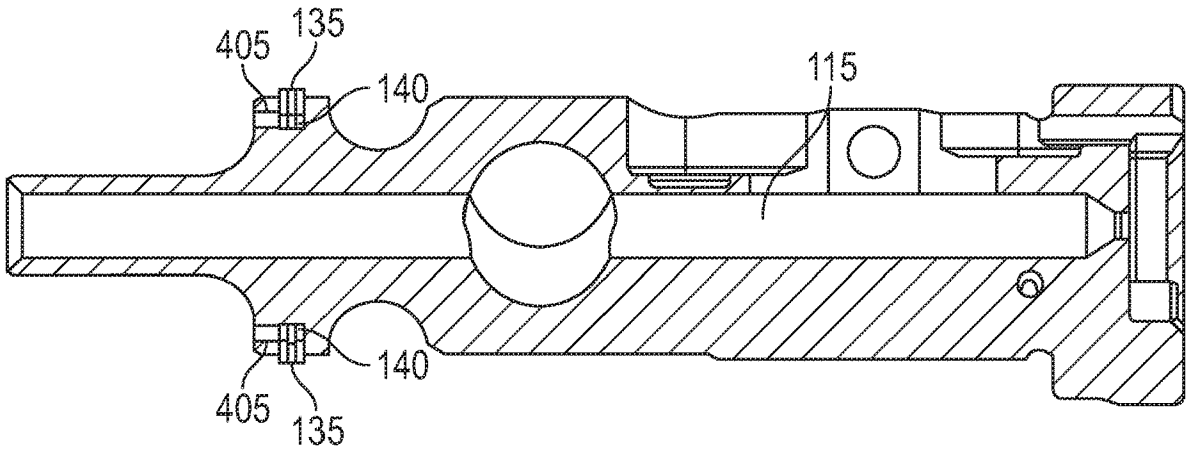
FIGS. 4A, 4B, and 4C show a bolt having lateral gas ports.
Figure 4C:
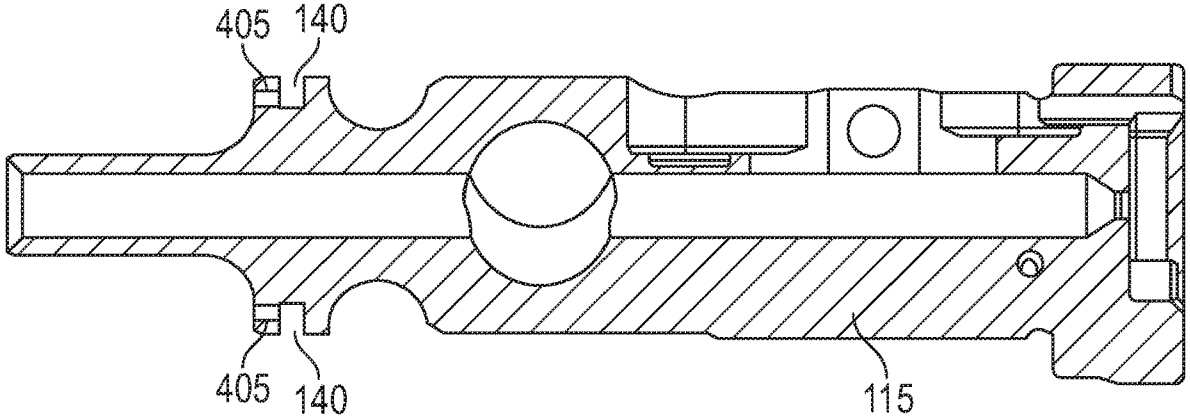
Figure 4A:
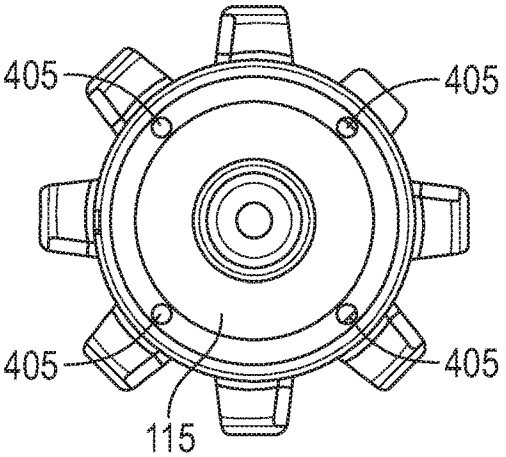

FIGS. 4A, 4B, and 4C show bolt 115 having lateral gas ports 405. FIG. 4A shows an axial view of the rear of bolt 115. FIG. 4A shows four lateral gas ports 405, however, bolt 115 may have any number of lateral gas ports 405 and is not limited to four. FIG. 4B shows bolt 115 having lateral gas ports 405 with gas ring assembly 135 included in gas ring groove 140. FIG. 4C shows bolt 115 having lateral gas ports 405 with gas ring assembly 135 removed. Lateral gas ports 405 may be applied to gain the same advantage as vertical gas ports 155 as described above and may provide a more direct route to the back side (i.e., underneath) of gas ring assembly 135.

Figure 5:
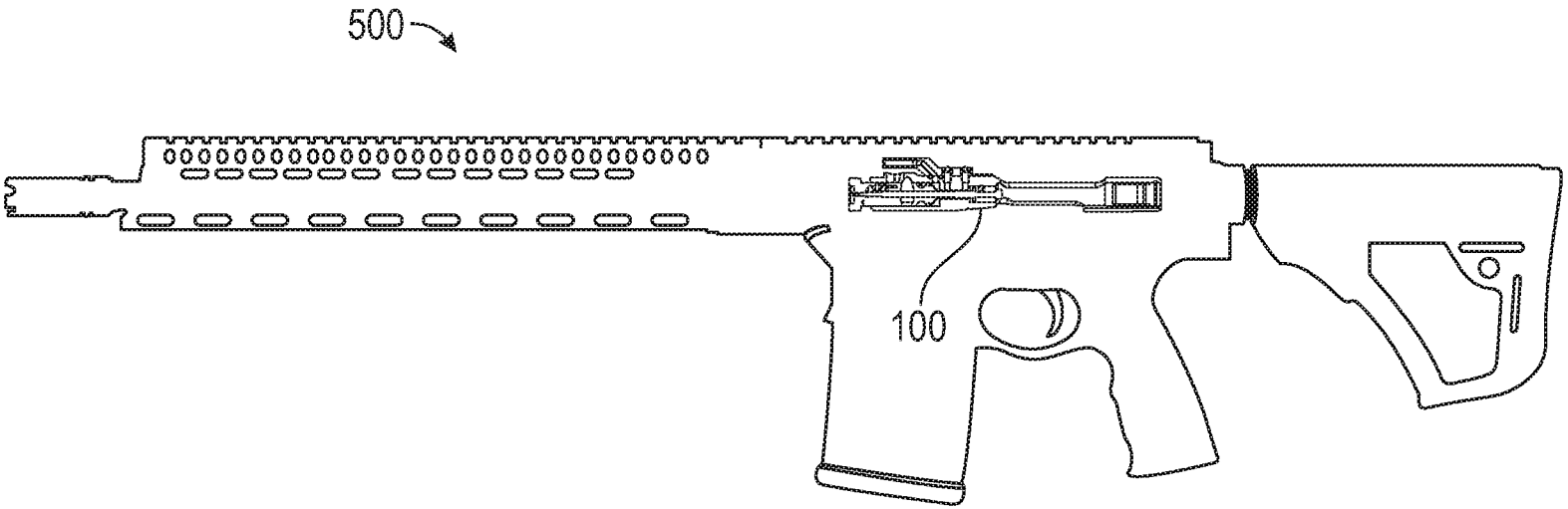
FIG. 5 shows a bolt carrier disposed in a rifle.

FIG. 5 shows a gas operated rifle 500. As shown in FIG. 5, bolt carrier 100 may be disposed in gas operated rifle 500. Gas operated rifle 500 may comprise a self-loading firearm that may comprise, for example, a semi-automatic rifle or a fully-automatic rifle. Consistent with embodiments of the disclosure, gas ports, both lateral and vertical, may be applied to any firearm operating system utilizing gas pressure that may come in contact with a gas ring (i.e., gas ring assembly 135). Included are both a smaller caliber rifle and a larger caliber shotgun with a gas piston system, both which employ gas rings for improved sealing to operate the firearm.

Embodiments of the present disclosure, for example, are described above with reference to block diagrams and/or operational illustrations of methods and systems, according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. A bolt comprising:

a gas ring groove;

a gas ring assembly disposed in the gas ring groove, the gas ring assembly being in contact with a first side of the gas ring groove and a second side of the gas ring groove; and at least one vertical gas port that provides a pathway to a volume underneath the gas ring assembly, the at least one vertical gas port being disposed in the first side of the gas ring groove and the second side of the gas ring groove not having a gas port.

2. The bolt of claim 1, wherein the gas ring assembly comprises one ring.

3. The bolt of claim 2, wherein the one ring comprises a gap.

4. The bolt of claim 1, wherein the gas ring assembly comprises a plurality of rings.

5. The bolt of claim 4, wherein each of the plurality rings comprises a gap.

6. The bolt of claim 1, wherein the bolt is disposed in a bolt carrier.

* * * * *